United States Patent [19]

Saxton

[11] Patent Number: 4,531,319

[45] Date of Patent: Jul. 30, 1985

[54] HANGING MOBILE GREETING CARD

[76] Inventor: Ronald P. Saxton, 5019 N. High St., Columbus, Ohio 43214

[21] Appl. No.: 669,380

[22] Filed: Nov. 8, 1984

[51] Int. Cl.[3] ..... G09F 1/08

[52] U.S. Cl. ..... 40/539; 40/124.1; 40/617; 446/147

[58] Field of Search ..... 40/539, 124.1, 617; 446/210, 147, 148

[56] References Cited

U.S. PATENT DOCUMENTS 1,853,615 4/1932 Howard ..... 40/539

3,015,898 1/1962 Keeslar ..... 40/124.1

FOREIGN PATENT DOCUMENTS 1052406 1/1954 France ..... 40/124.1

*Primary Examiner*—Robert Peshock

*Assistant Examiner*—Cary E. Stone

*Attorney, Agent, or Firm*—Robert B. Watkins

[57] ABSTRACT

A novelty greeting card with a hanging mobile configuration constructed of planar semirigid flexible material comprised of two hingedly connected side members. These side members have base portions which are bent into a perpendicular position to overlap and form a base foundation. This base portion supports an upper structure from which the hanging mobile or other visual attraction is suspended. The card and the hanging mobile are printed with appropriate visual indicia of a coordinated nature to enhance and complete the presentation of the card.

12 Claims, 3 Drawing Figures

HANGING MOBILE GREETING CARD

BACKGROUND OF THE INVENTION

The greeting card industry has grown rapidly in recent years as new developments in materials and public tastes have evolved. Greeting cards now are used much more frequently for more than the traditional occasions of birthdays, Mother's day and Christmas. New designs include metallic art, musical cards, picture frames, games and puzzles, and pop-ups. All these new designs in greeting cards have found a willing market as personal communication through the mail has increased as a popular means of expression. The increasing expense of most art and gift items have boosted this phenomenon.

The prior patent art includes the following:

U.S. Pat. No. 4,140,317—Ramney, discloses a containerized greeting card and game toy combination, constructed of cardboard, plastic or similar material. It is made up of several sections forming panels and flaps foldable along folding lines into a flat container secured by a closing device in the folded position.

U.S. Pat. No. 3,235,988—Paige, reveals an animated "pop-up" greeting card designed so that when the pages of the card are opened, an accessory panel moves from a position between the pages to a position thereabove.

U.S. Pat. No. 3,228,139—Lohnes, shows a foldable novelty device of a cardboard design. When removed from an envelope or the like the cardboard with its retained object will assume a different position to form a novelty or utilitarian device.

U.S. Pat. No. 3,191,328—Lohnes, discloses a foldable animated greeting card made from a single sheet of stiff paper or cardboard. A movable panel between the cover and back panel when opened and closed forms an object hingedly attached to one part of the cut-out back panel.

U.S. Pat. No. 2,148,279—Sandberg, reveals a folding postcard or window display characterized by a pictorial illustration, cutout features of a principal subject or subjects standing out in relief, and a means for folding said illustration and cutout features in a particular manner, all in one operation.

The prior art has, however, not included a greeting card which comprises a hanging attraction such as a mobile. This invention serves to expand upon this concept to create a motif for a greeting card which encompasses the mobile into a scenic presentation coordinated with a printed message. In this way, the card of this invention takes on many aspects of a gift item as well.

SUMMARY OF THE INVENTION

This invention relates to a design for a novelty greeting card comprising a "mobile" and its supporting mechanism.

More specifically, the apparatus of this invention is an assembly comprising a planar card-like semirigid flexible material element hingedly connected along a bend line on one axis with the bend line slitted on at least one end. Each side member formed by this first bend axis has a second bend along an axis generally perpendicular to the first bend axis. This first axis meets the second axis at a position juxtaposed to the internal end of the slit of the first axis. These secondary bends allow for the establishment of a base portion on each side member. The planar material is folded along the first and second axes so that the base portions overlap and form a unified foundation which is held firmly by a tab and slit configuration interlocking the base members.

In the display position, the side members are angularly facing sides drawn together and unifyingly fastened at a position removed from the intersecting axes and the base portions. Attached to one of the side members near this unifying point is the hanging mobile member comprised of a plurality of hanging objects connected by thin filament threads. Printed on the side members and the hanging mobile member are indicia of compatible visual association representing visual scenes of interest to the viewer of the device.

In the mailable transport configuration, the side members are hingedly folded along the first axis bend line until the side members overlap to substantially contact one another. The base portions are folded along the second axis bend line until the base portions are substantially in the plane parallel to the side portion. The mobile display indicia are connected to at least one of the side members and folded within or upon the planar surfaces of the side members by the fastening means.

In the use of this invention, instructions to assist the recipient of this novelty greeting card may be printed on the surface of the base portion which is covered over by the base portion having the printed indicia upon completion of the display assembly.

It is possible that the hanging member may be a wind chime or another hanging attraction which become a part of the overall presentation motif of the greeting card.

It is an object of this invention to provide a new and original greeting card which adds a unique quality to the message. It is a further object to combine the greeting card aspect of the invention with the longer term nature of a gift by creating a lasting pleasurable visual display. Additionally, the act of assembling this card display has some of the aspects of a game or puzzle. It is yet another object of this invention that this novel greeting card and gift combination should be foldable into a flat, mailable configuration for easy transport.

The foregoing and other advantages of the invention will become apparent from the following disclosure in which a preferred embodiment of the invention is described in detail and illustrated in the accompanying drawings. It is contemplated that variations in procedures, structural features and arrangement of parts may appear to the person skilled in the art without departing from the scope or sacrificing any of the advantages of the invention.

DETAILED DESCRIPTION OF THE INVENTION

Figure 1:
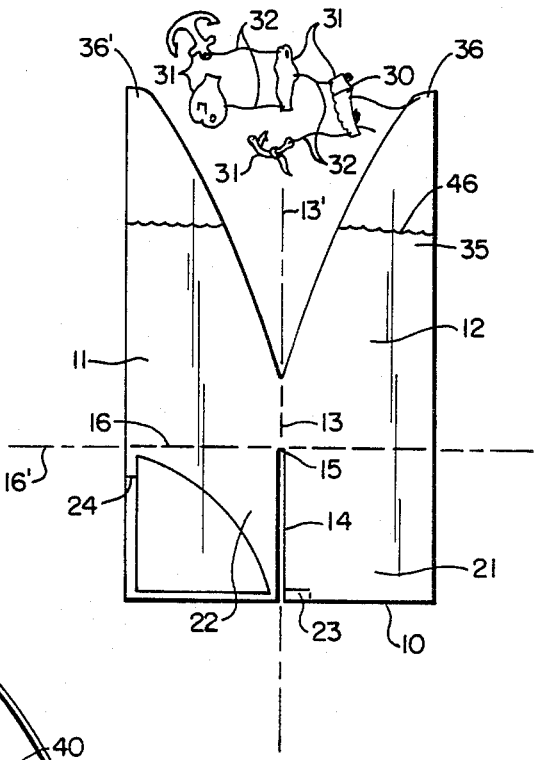
FIG. 1 is a plan view of the card-like semirigid flexible material element of this invention with one possible configuration of attached indicia.

In FIG. 1, according to this invention, a planar card-like semirigid flexible material element 10 is shown with side members 11, 12 hingedly attached along a bend line 13 on a first axis 13'. One end of bend line 13 has a slit 14 which extends into the planar element 10 to a point 15 along a second bend line 16 on a second axis 16'. This second axis 16' is generally perpendicular to the first axis 13' and the second bend line 16 establishes base portions 21, 22 of the side members 12, 11 respectively. Base portion 21 contains a tab member 23 which, when the card is folded along bend line 13 and the base portions are folded along line 16, interlocks with a slit 24 to form a base foundation 25, shown more clearly in FIG. 3.

Referring again to FIG. 1, a hangable display object 30, such as a mobile, of this invention is comprised of a plurality of indicia carrying elements 31 connected by filaments 32 shown fixedly attached to at least one side member 12 by stapling or other means. Printed on the flexible card-like material element 10 of this invention in a graphic or colorful indicia 35 which creates a compatible visual association with the hanging mobile 30.

Figure 3:
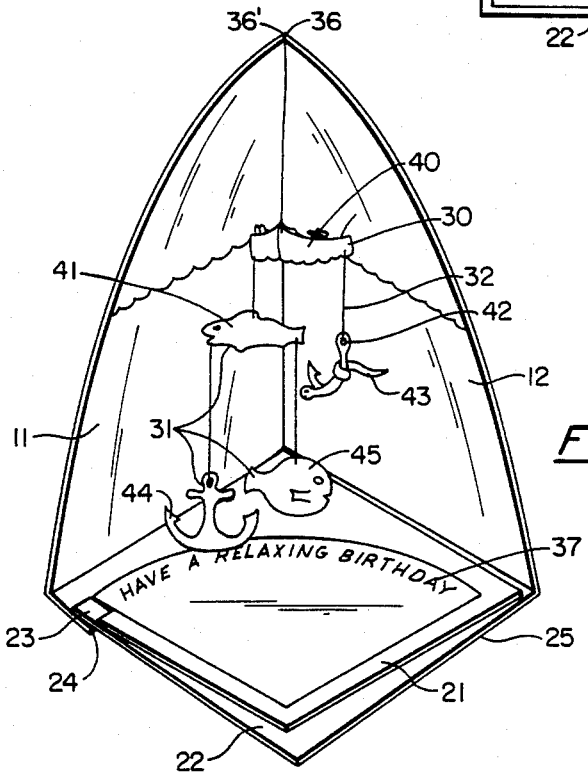
FIG. 3 is a perspective view of the greeting card embodying the present invention showing final assembly.

When the planar card-like semirigid flexible material element 10 of this invention is assembled, as shown in FIG. 3, hingedly connected side members 11, 12 are folded perpendicularly along fold line 13 so that they may be unifyingly fastened at a position 36 on side member 12 and 36' on side member 11.

The colorful indicia of this invention will also contain an appropriated printed message 37 compatible with the thematic message of the greeting card of this invention.

Figure 2:
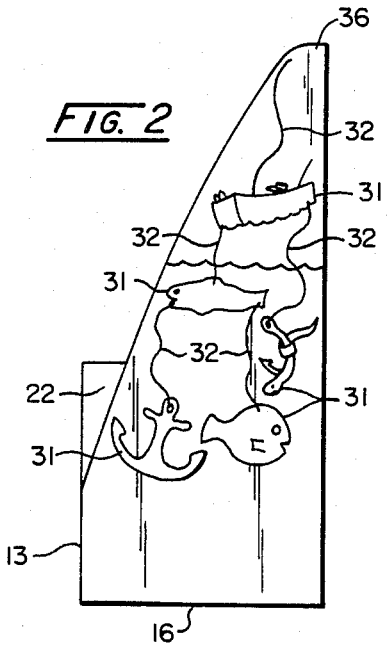
FIG. 2 is a plan view of the novelty greeting card of this invention folded into a position for insertion into an envelope.

When the planar card-like semirigid flexible material element 10 of this invention is in its transport configuration to be mailed, as in FIG. 2, the side members 11, 12 are folded along the first bend line 13 so that the side members overlap and substantially contact one another. The base portions 21, 22 are hingedly folded along the second bend line 16 until the base portions 21, 22 are substantially in the plane parallel to the side portions 11, 12. The hanging mobile display object 30 is attached to at least one side member 11 or 12 and folded within or upon the planar surface of the side member by fastening means (not shown). Thus the novelty greeting card of this invention may be placed within a standard envelope of moderate size.

On the greeting card shown in FIGS. 1, 2 and 3, the theme relates to the sea and the indicia and display objects in the mobile have an association with this subject matter. It will be seen that the first upper tier of the mobile is a boat 40 from which is suspended a fish 41 at one end and a fish hook 42 at the other end. The fish hook 42 is shown to have a worm 43. The fish 41 has an anchor 44 suspended at one end and another fish 45 suspended at the other end. The background indicia on the side members 11 and 12 shows the surface of the sea 46 upon which the boat 40 appears to float when the card is assembled as shown in FIG. 3. Of course other display objects that are thematic with the sea could be a part of this particular mobile, such as divers, sunken treasurers, sea horses, etc.

If the card were thematic of the sky, stars and other heavenly bodies, such as angels, could be used. If the theme of the card was forests and vegetations, animals, birds, and insects could be the mobile objects.

Therefore, it will be appreciated that the receipient of the card is conveyed an impression of animated three dimensional interest which stands alone as a point of interest in any setting.

It is understood that the card may be any suitable size and material, and contain any desired illustration and wording.

As a further aspect of this invention, a plurality of different similar greeting cards of this invention may be made in sets with matching themes but different display objects, creating even further interest in the subject matter.

Although a preferred embodiment of the invention has been herein described, it will be understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalence thereof.

I claim:

1. A foldable novelty and/or display device comprising:

(a) a planar card-like semirigid flexible material element including opposing side members hingedly connected along a bend line on a first axis with the bend line slitted on at least one end, each side member having a bend line on a second axis intersecting the first axis at a position juxtaposed to the internal end of the slit, to establish a base portion of each side member;

(b) the planar material being foldable on the first and second axes bend lines to overlap the base portions and establish a unified foundation configuration, and to fold the side members into a position of angularly facing sides, the side members being fastened together to unify the facing sides at a position removed from the intersecting axes; and (c) a display object suspended from the unified facing sides.

2. A device according to claim 1 wherein the axes are substantially perpendicular.

3. A device according to claim 1 wherein the side members are rectangular.

4. A device according to claim 1 wherein at least one of the side members and base members present indicia representing visual scenes of interest to a viewer of the device.

5. A device according to claim 1 wherein the base portions are provided with at least one tab and slit constructed to interact and restrain the base portions to remain in their folded unified foundation configuration.

6. A device according to claim 1 wherein the display object is a mobile having a suspended plurality of other objects with indicia of compatible visual association with the indicia on the side member.

7. A foldable novelty and/or display device comprising:

(a) in the manufacturing configuration:

(i) a planar card-like semirigid flexible material element including side by side members connected along a creased bend line on a first axis with the bend line slitted at at least one end, each side member having a creased bend line on a second axis intersecting the first axis and bend line at a position juxtaposed to the internal end of the slit to establish a base portion on opposite sides of the first axis and bend line;

(ii) a display object constructed to be fastened to at least one side of the side members; and (iii) means for fastening the display object to the at least one side member.

(b) in the transport configuration:

(i) the side members being hingedly folded along the first axis bend line until the side members overlap to substantially contact one another;

(ii) the base portions hingedly folded along the second axis bend line until the base portions are substantially in the plane parallel to the side portion; and (iii) the display object being connected to at least one of the side members and folded within or upon the planar surfaces of the side members by the fastening means; and (c) in the display configuration:

(i) the hingedly connected side members being folded into a position of angularly facing sides, with the facing sides unified at a position removed from the intersecting axes;

(ii) the base portions being folded to overlap and establish a unified foundation supporting the side members in a substantially upright position; and (iii) the display object being suspended and supported from the unified facing sides by the fastening means above the base portions.

8. A device according to claim 7 wherein the axes are substantially perpendicular.

9. A device according to claim 7 wherein the side members are rectangular.

10. A device according to claim 7 wherein at least one of the side members and base members present indicia representing visual scenes of interest to a viewer of the device.

11. A device according to claim 7 wherein the base portions are provided with at least one tab and slit constructed to interact and restrain the base portions to remain in their folded unified foundation configuration.

12. A device according to claim 10 wherein the display object is a mobile having a suspended plurality of other objects with indicia of compatible visual association with the indicia on the side member.

* * * * *